US006820594B2

(12) United States Patent
Rodriguez-Amaya et al.

(10) Patent No.: US 6,820,594 B2
(45) Date of Patent: Nov. 23, 2004

(54) VALVE FOR CONTROLLING A COMMUNICATION IN A HIGH-PRESSURE FLUID SYSTEM, IN PARTICULAR IN A FUEL INJECTION SYSTEM FOR AN INTERNAL COMBUSTION ENGINE

(75) Inventors: Nestor Rodriguez-Amaya, Stuttgart (DE); Walter Egler, Gerlingen (DE); Christoph Hollmann, Ludwigsburg (DE); Hubert Greif, Markgroeningen (DE); Godehard Nentwig, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 53 days.

(21) Appl. No.: 10/360,738

(22) Filed: Feb. 10, 2003

(65) Prior Publication Data

US 2004/0079335 A1 Apr. 29, 2004

(30) Foreign Application Priority Data

Feb. 8, 2002 (DE) ..... 102 05 218

(51) Int. Cl.[7] ..... F02M 33/04
(52) U.S. Cl. ..... 123/446; 123/467
(58) Field of Search ..... 123/446–447, 123/467; 251/117, 118, 121; 137/625.3, 625.33; 138/40–46

(56) References Cited

U.S. PATENT DOCUMENTS 2,336,653 A * 12/1943 Taylor ..... 137/625.3
3,857,542 A * 12/1974 Heymann ..... 251/120
4,941,447 A * 7/1990 Mannhardt ..... 123/455
5,163,476 A * 11/1992 Wessman ..... 137/625.3
6,082,405 A * 7/2000 Qvarfordh et al. ..... 137/625.37
6,152,158 A * 11/2000 Hu ..... 137/14

* cited by examiner

*Primary Examiner*—Thomas Moulis
(74) *Attorney, Agent, or Firm*—Ronald E. Greigg

(57) ABSTRACT

The valve having a valve member guided displaceably in the direction of its longitudinal axis protrudes into a valve pressure chamber and has a sealing face extending transversely to axis, has a sealing face, which it cooperates with a valve seat, extending transversely to axis, for at least extensively closing off an opening, surrounded by the valve seat, from the valve pressure chamber. The sealing face is surrounded by an annular face, which when the valve member rests on the valve seat is disposed at a slight spacing from the valve seat. The valve member has a plurality of apertures, distributed over its circumference, through which the opening communicates with the valve pressure chamber when the valve member is resting on the valve seat.

20 Claims, 2 Drawing Sheets

VALVE FOR CONTROLLING A COMMUNICATION IN A HIGH-PRESSURE FLUID SYSTEM, IN PARTICULAR IN A FUEL INJECTION SYSTEM FOR AN INTERNAL COMBUSTION ENGINE

BACKGROUND OF THE INVENTION

1. Field of the Invention

The invention is directed to an improved valve for controlling a communication in a high-pressure fluid system, in particular in a fuel injection system for an internal combustion engine.

2. Description of the Prior Art

One valve of the type with which this invention is concerned, known from European Patent Disclosure EP 0 840 003 A, serves to control a communication in a fuel injection system for an internal combustion engine. The valve has a valve member, which is guided displaceably in the direction of its longitudinal axis and protrudes into a pressure chamber, and which in the pressure chamber has a sealing face, on a face end disposed transversely to its longitudinal axis. The valve member, with its sealing face, cooperates with a valve seat, disposed transversely to its longitudinal axis, for closing off an opening, surrounded by the valve seat, from the pressure chamber. High pressure prevails in the pressure chamber, and the opening leads to a relief chamber, and the communication of the pressure chamber with the relief chamber and thus the pressure in the pressure chamber are controlled by the valve member. To achieve secure sealing off of the opening from the pressure chamber, a high pressure per unit of surface area of the sealing face on the valve seat is needed. To limit the requisite contact pressure of the valve member on the valve seat to a magnitude that can still be controlled, it is necessary to embody the sealing face with the smallest possible surface area. Because of the impact load that occurs when the valve member, with its sealing face, strikes the valve seat, damage to the sealing face can easily occur, in the form of broken-out places. Through these broken-out places, fluid from the pressure chamber can flow out via the opening. Because of the high pressure difference, very high flow velocities occur, which leads to erosion, or in other words a removal of material from the valve member, thus enlarging the broken-out places. As a result, with increasing time in use of the valve, the sealing action becomes poorer, and finally the valve is no longer functional. Because of production variations in the valve member and/or the valve seat, small through openings may also be present between the sealing face and the valve seat, which as indicated above enlarge over the time in use of the valve and lead to functional failure.

SUMMARY OF THE INVENTION

The valve according to the invention has the advantage over the prior art that the valve function is assured even over a long time in use of the valve. By means of the apertures of the valve member, a slight leakage is brought about intentionally, but this is not significant to the function of the valve, and by means of the annular face, it is attained that when fluid flows out of the pressure chamber, only a low flow velocity occurs, and so there is not erosion of the valve member or the valve seat. The valve thus has only slight overall leakage, which, however, remains at least approximately constant over the time in use.

Various advantageous features and refinements of the valve of the invention are disclosed. One embodiment makes a simple embodiment of the apertures possible. Another embodiment makes a low flow velocity of the fluid flowing out of the pressure chamber possible and the flow velocity of the outflowing fluid may be made at least approximately constant. A further embodiment makes simple production of the valve member possible.

BRIEF DESCRIPTION OF THE DRAWINGS

Other features and advantages of the invention will become apparent from the following detailed description, taken in conjunction with the drawings, in which.

DESCRIPTION OF THE PREFERRED EMBODIMENT

Figure 1:
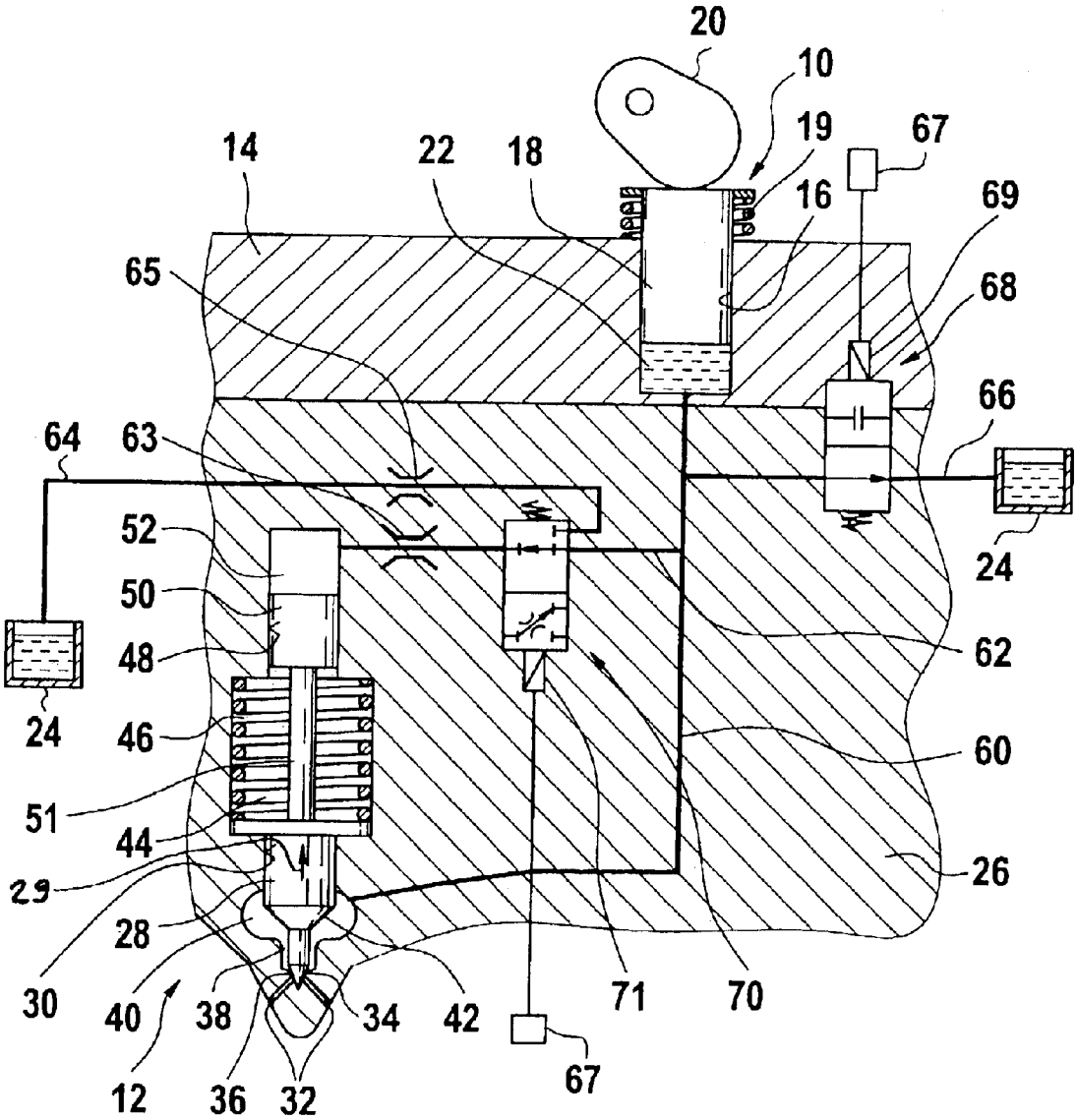
FIG. 1 is a longitudinal sectional view schematically showing a fuel injection system with a valve for use in an internal combustion engine.

In FIG. 1, a fuel injection system for an internal combustion engine of a motor vehicle is shown. The engine is preferably a self-igniting internal combustion engine. The fuel injection system is preferably embodied as a so-called unit fuel injector, and for each cylinder of the engine, it has one high-pressure fuel pump 10 and one fuel injection valve 12, communicating with the pump, which form a common unit. Alternatively, the fuel injection system can be embodied as a so-called pump-line-nozzle system, in which the high-pressure fuel pump and fuel injection valve of each cylinder are disposed separately from one another and communicate with one another via a line. The high-pressure fuel pump 10 has a pump body 14 with a cylinder bore 16, in which a pump piston 18 is guided tightly; the piston is driven at least indirectly by a cam 20 of a camshaft of the engine, counter to the force of a restoring spring 19, to execute a reciprocating motion. In the cylinder bore 16, the pump piston 18 defines a pump work chamber 22, in which fuel is compressed at high pressure in the pumping stroke of the pump piston 18. Fuel is delivered to the pump work chamber 22 from a fuel tank 24 of the motor vehicle.

The fuel injection valve 12 has a valve body 26, which is connected to the pump body 14 and can be embodied in multiple parts, and in which an injection valve member 28 is guided longitudinally displaceably in a bore 30. The valve body 26, in its end region toward the combustion chamber of the cylinder of the engine, has at least one and preferably a plurality of injection openings 32. The injection valve member 28, in its end region toward the combustion chamber, has a sealing face 34, which for instance is approximately conical and which cooperates with a valve seat 36, embodied in the valve body 26 in its end region toward the combustion chamber, from which or downstream of which valve seat the injection openings 32 lead away. In the valve body 26, between the injection valve member 28 and the bore 30, toward the valve seat 36, there is an annular chamber 38, which in its end region remote from the valve seat 36 changes over, by means of a radial widening of the bore 30, into a pressure chamber 40 surrounding the injection valve member 28. At the level of the pressure chamber 40, as a result of a cross-sectional reduction, the injection valve member 28 has a pressure shoulder 42. The end of the injection valve member 28 remote from the combustion chamber is engaged by a prestressed closing spring 44, by which the injection valve member 28 is pressed toward the valve seat 36. The closing spring 44 is disposed in a spring chamber 46 of the valve body 26 that adjoins the bore 30.

The end of the spring chamber 46 remote from the bore 30 in the valve body 26 is adjoined by a further bore 48, in which a control piston 50 that is connected to the injection valve member 28 is guided tightly. The bore 48 forms a control pressure chamber 52, which is defined by the control piston 50 in the form of a movable wall. The control piston 50 is braced, via a piston rod 51 that is smaller in diameter than the control piston, on the injection valve member 28 and can be connected to the injection valve member 28. The control piston 50 can be embodied integrally with the injection valve member 28, but for the sake of assembly it is preferably connected to the injection valve member 28 in the form of a separate part.

From the pump work chamber 22, in FIG. 1, a conduit 60 leads through the pump body 14 and the valve body 26 to the pressure chamber 40 of the fuel injection valve 12. From the pump work chamber 22 or from the conduit 60, a conduit 62 leads to the control pressure chamber 52. A conduit 64 can also be made to communicate with the control pressure chamber 52; this conduit forms a communication with a relief chamber, as which the fuel tank 24 or some other region in which a low pressure prevails can serve, as least indirectly. From the pump work chamber 22 or from the conduit 60, a communication 66 leads to a relief chamber, which is controlled by a first electrically actuated control valve 68. The fuel tank 24 or some other low-pressure region can serve at least indirectly as the relief chamber. The control valve 68 can, as shown in FIG. 1, be embodied as a 2/2-way valve. The switching of the control valve 68 between its two switching positions is effected by an actuator 69, which can for instance be an electromagnet, counter to a restoring spring.

For controlling the pressure in the control pressure chamber 52, a second electrically actuated control valve 70 is provided. The second control valve 70 is embodied as a 3/2-way valve, which can be switched back and forth between two switching positions. In a first switching position of the control valve 70, this valve causes the control pressure chamber 52 to communicate with the pump work chamber 22 and to be disconnected from the relief chamber 24, and in a second switching position of the control valve 70, the control pressure chamber 52 is disconnected from the pump work chamber 22 by this valve and made to communicate with the relief chamber 24. A throttle restriction 63 is provided in the communication 62 of the control pressure chamber 52 with the pump work chamber 22, and a throttle restriction 65 is provided in the communication 64 of the control pressure chamber 52 with the relief chamber 24. The throttle restriction 63 can be disposed upstream of the control valve 70 in the communication 62, or, as shown in FIG. 1, downstream of the control valve 70 in the communication 62. The control valve 70 has an actuator 71, which may be an electromagnet, and by which the control valve 70 can be switched back and forth between its two switching positions counter to a restoring spring. The two control valves 68, 70 are triggered by an electronic control unit 67.

Figure 2:
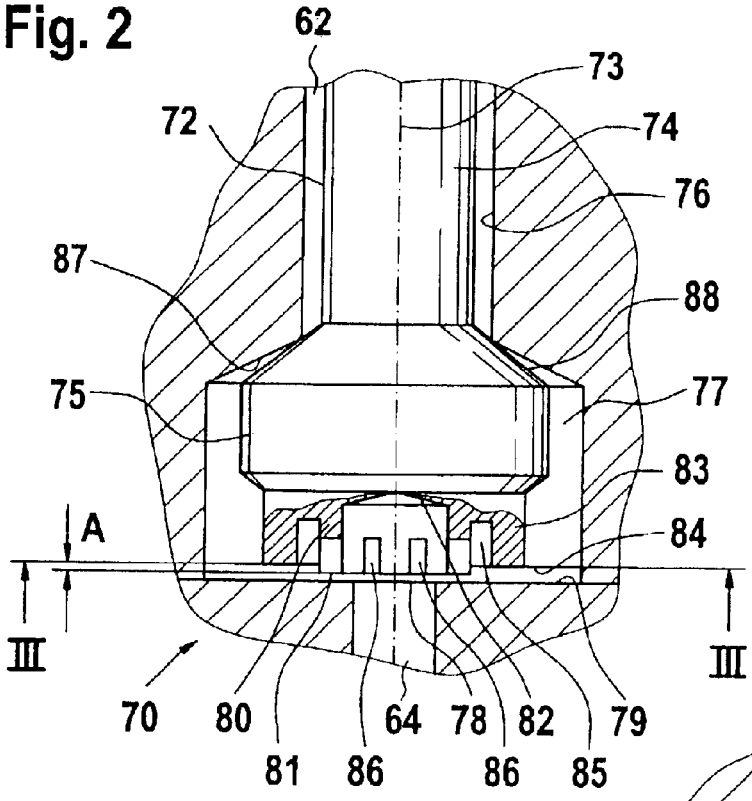
FIG. 2, in an enlarged view, shows the valve in a longitudinal section.
Figure 3:
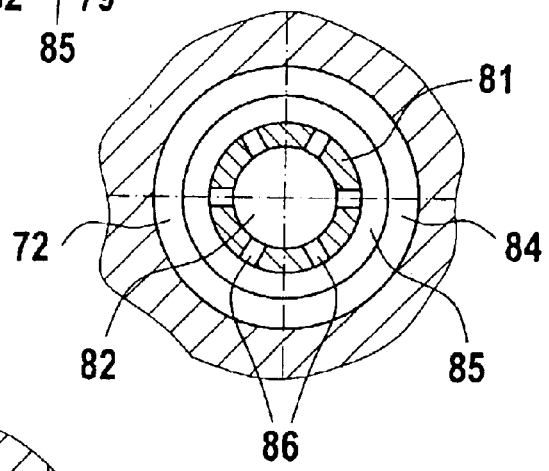
FIG. 3 shows the valve in a cross section taken along the line III—III in FIG. 2.

The second control valve 70 will now be explained in further detail in conjunction with FIGS. 2 and 3. The control valve 70 has a valve member 72, which is guided displaceably in the direction of its longitudinal axis 73 via a shaft 74, and which with an end region 75 of enlarged diameter compared to the shaft 74 protrudes into a valve pressure chamber 77. The communication 62 to the pump work chamber 22 discharges into the valve pressure chamber 77 on one side, and the communication 64 to the relief chamber 24 discharges into it on the other side. The communication 62 extends in the form of an annular gap embodied between the shaft 74 and a bore 76 surrounding it. The bore 76 is embodied with a smaller diameter than the valve pressure chamber 77. The communication 64 discharges into the valve pressure chamber 77 at an opening 78 and is surrounded by a face 79, which extends transversely, and preferably at least approximately perpendicular, to the longitudinal axis 73 of the valve member 72 and forms a valve seat. The valve member 72, toward the valve seat 79, has an at least approximately cylindrical extension 80, whose face end forms a sealing face 81 that extends transversely, preferably at least approximately perpendicular, to the longitudinal axis 73 of the valve member 72. The extension 80 has a smaller diameter than the end region 75 of the valve member 72, but the diameter of the extension 80 is greater than that of the opening 78. Inside the extension 80, an indentation 82 is embodied on the face end, so that the sealing face 81 is annular.

The inner extension 80 of the valve member 72 is surrounded by a further at least approximately cylindrical outer extension 83 of larger diameter. An annular face 84 surrounding the sealing face 81 is formed on the face end of the outer extension 83 and is offset from the sealing face 81 in the direction of the longitudinal axis 73 of the valve member 72, so that the sealing face 81 protrudes toward the valve seat 79 by an amount A relative to the annular face 84. The annular face 84 extends transversely to the longitudinal axis 73 of the valve member 72, and preferably approximately perpendicular to the longitudinal axis 73. Between the inner extension 80 and the outer extension 83, an annular groove 85 indented relative to the annular face 84 is also embodied on the face end. In the jacket of the inner extension 80, distributed over its circumference, a plurality of apertures 86 are provided, which preferably extend at least approximately radially to the longitudinal axis 73 of the valve member 72. The apertures 86 create a communication between the valve pressure chamber 77, surrounding the jacket of the inner extension 80, and the indentation 82 inside the extension 80. The apertures 86 are preferably embodied as grooves made in the extension 80 and preferably originating at the sealing face 81.

At the transition from the bore 76 to the valve pressure chamber 77, a conical transition face 87 is provided, which forms a second valve seat. At the transition from the end region 75 to the shaft 74, a second, conical sealing face 88 is disposed on the valve member 72; it cooperates with the valve seat 87 to control the communication 62. In the first switching position of the control valve 70, the valve member 72 rests with its second sealing face 88 on the second valve seat 87, so that the communication 62 with the pump work chamber 22 is severed. In the second switching position of the control valve 70, the valve member 72 with its second sealing face 88 is spaced apart from the second valve seat 87, so that the communication 62 to the pump work chamber 22 is opened. The end region 75 of the valve member 72 in the valve pressure chamber 77 is preferably at least approximately pressure-balanced, so that essentially no resultant pressure force in the direction of its longitudinal axis 73 is exerted on the valve member 72.

In the second switching position of the control valve 70, the valve member 72 rests with its sealing face 81 on the valve seat 79, and the annular face 84 is disposed at the spacing A from the valve seat 79, so that between the annular face and the valve seat 79, an annular-gaplike flow cross section remains open. The second sealing face 88 of the valve member 72, in the second switching position, is disposed with spacing from the second valve seat 87, so that high pressure prevails in the valve pressure chamber 77. From the valve pressure chamber 77, fuel can flow through the flow cross section and the apertures 86 in the valve member 72 into the indentation 82, and from there via the opening 78 and the communication 64 into the relief chamber 24. The control valve 70 thus has a defined leakage; the leakage is kept slight by an appropriate selection of the number and cross-sectional area of the apertures 86. The flow of fuel flowing out of the valve pressure chamber 77 through the flow cross section between the annular face 84 and the valve seat 79 thus takes place at a low flow velocity, and preferably a laminar flow develops. The flow velocity at the apertures 86 is likewise low, so that no erosion occurs at the valve member 72 or at the valve seat.

Figure 4:
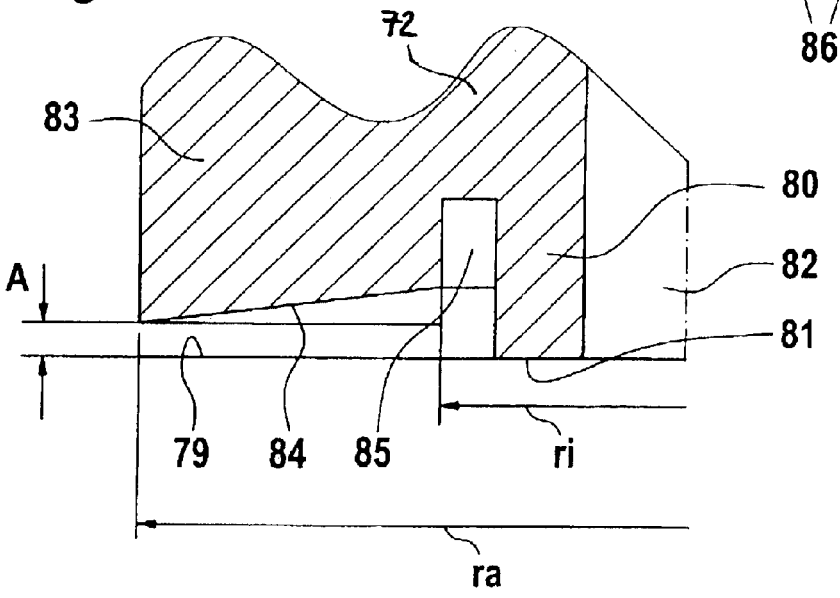
FIG. 4 shows an enlarged detail of the valve, marked IV in FIG. 2.

In FIG. 4, a modified version of the control valve 70 is shown, in which the annular face 84 of the valve member 72 does not extend perpendicular to the longitudinal axis 73 of the valve member 72, but instead extends such that beginning at its radially inner edge toward its radially outer edge, it approaches the valve seat 79 and thus the spacing A decreases. The annular face 84 can be embodied as at least approximately conical. Preferably, the annular face 84 is embodied conically in such a way that the flow cross section between the annular face 84 and the valve seat 79, when the valve member 72 is resting with its sealing face 81 on the valve seat 79, is at least approximately constant over the radial course of the annular face. The flow cross section is formed by a cylindrical jacket face, which results as the product of the circumference, which is the product of twice the radius and $\pi$, and the spacing A. As a result, it is attained that the flow velocity of the fuel is at least approximately constant, and no acceleration of the flow occurs. The annular face 84 can alternatively be embodied as arched.

The function of the fuel injection system will now be explained. Fuel from the fuel tank 24 is delivered to the pump piston 18 in its intake stroke. Fuel injection begins in the pumping stroke of the pump piston 18, with a preinjection in which the first control valve 68 is closed by the control unit 67, so that the pump work chamber 22 is disconnected from the relief chamber 24. The control unit 67 also puts the second control valve 70 in its second switching position, so that the control pressure chamber 52 now communicates with the relief chamber 24 and is disconnected from the pump work chamber 22. In that case, high pressure cannot build up in the control pressure chamber 52. When the pressure in the pump work chamber 22 and thus in the pressure chamber 40 of the fuel injection valve 12 is so great that the pressure force exerted by this pressure on the injection valve member 28 via the pressure shoulder 42 is greater than the total of the force of the closing spring 44 and the pressure force acting on the control piston 50 as a result of the residual pressure operative in the control pressure chamber 52, the injection valve member 28 moves in the opening direction 29 and opens the at least one injection opening 32.

To terminate the preinjection, the second control valve 70 is put in its first switching position by the control unit, so that the control pressure chamber 52 is disconnected from the relief chamber 24 and communicates with the pump work chamber 22. The first control valve 68 remains in its closed position. In the control pressure chamber 52, high pressure builds up, as in the pump work chamber 22, so that a high pressure force in the closing direction acts on the control piston 50, and the injection valve member 28 is moved into its closing position.

For an ensuing main injection, the second control valve 70 is put in its second switching position by the control unit 67, so that the control pressure chamber 52 communicates with the relief chamber 24 and is disconnected from the pump work chamber 22. The fuel injection valve 12 then opens, as a consequence of the reduced pressure force on the control piston 50, and the injection valve member 28 moves into its open position.

To terminate the main injection, the second control valve 70 is put in its first switching position by the control unit 67, so that the control pressure chamber 52 is disconnected from the relief chamber 24 and communicates with the pump work chamber 22, and high pressure builds up in the pump work chamber, and via the force acting on the control piston 50, the fuel injection valve 12 is closed. After the main injection, a postinjection can also ensue, for which purpose the second control valve 70 is put in its second switching position. To terminate the postinjection, the second control valve 70 is returned to its first switching position, and/or the first control valve 68 is opened.

A control valve 70 embodied as described above can also be employed in other fuel injection systems or high-pressure fluid systems for controlling a communication. The control valve 70 can also be embodied as a 2/2-way valve, a 2/3-way valve, or a 3/3-way valve.

The foregoing relates to preferred exemplary embodiments of the invention, it being understood that other variants and embodiments thereof are possible within the spirit and scope of the invention, the latter being define by the appended claims.

We claim:

1. In a valve for controlling a communication in a high-pressure fluid system, in particular in a fuel injection system for an internal combustion engine, having a valve member (72) that is guided displaceably in the direction of its longitudinal axis (73) and protrudes into a valve pressure chamber (77), in which high pressure prevails at least intermittently, and that in the valve pressure chamber (77), on a face end extending transversely to its longitudinal axis (73), has a sealing face (81), with which it cooperates with a valve seat (79), extending transversely to its longitudinal axis (73), for at least extensively closing off an opening (78), surrounding by the valve seat (79), from the valve pressure chamber (77), the improvement comprising an annular face (84) surrounding the sealing face (81) on the face end of the valve member (72) and disposed with slight spacing (A) from the valve seat (79) in the direction of its longitudinal axis (73) when the valve member (72) with its sealing face (81) is resting on the valve seat (79), and a plurality of apertures (86) formed in the valve member (72) and distributed over its circumference, the opening (78) communicating through the apertures (86) with the valve pressure chamber (77) when the valve member (72), with its sealing face (71), is resting on the valve seat (79).

2. The valve of claim 1, wherein the apertures (86) extend at least approximately radially to the longitudinal axis (73) of the valve member (72).

3. The valve of claim 1, wherein the apertures (86) are formed by grooves that are disposed in the sealing face (81) and are open toward the valve seat (79).

4. The valve of claim 2, wherein the apertures (86) are formed by grooves that are disposed in the sealing face (81) and are open toward the valve seat (79).

5. The valve of claim 1, wherein the annular face (84) is embodied such that over its radial course, beginning at its radially inner edge, toward its radially outer edge, it approaches the valve seat (79).

6. The valve of claim 2, wherein the annular face (84) is embodied such that over its radial course, beginning at its radially inner edge, toward its radially outer edge, it approaches the valve seat (79).

7. The valve of claim 3, wherein the annular face (84) is embodied such that over its radial course, beginning at its radially inner edge, toward its radially outer edge, it approaches the valve seat (79).

8. The valve of claim 5, wherein the annular face (84) is embodied as at least approximately conical.

9. The valve of claim 6, wherein the annular face (84) is embodied as at least approximately conical.

10. The valve of claim 7, wherein the annular face (84) is embodied as at least approximately conical.

11. The valve of claim 5, wherein the annular face (84) is embodied such that the size of an open flow cross section existing between it and the valve seat (79) is at least approximately constant over the radial course of the annular face (84).

12. The valve of claim 8, wherein the annular face (84) is embodied such that the size of an open flow cross section existing between it and the valve seat (79) is at least approximately constant over the radial course of the annular face (84).

13. The valve of claim 9, wherein the annular face (84) is embodied such that the size of an open flow cross section existing between it and the valve seat (79) is at least approximately constant over the radial course of the annular face (84).

14. The valve of claim 10, wherein the annular face (84) is embodied such that the size of an open flow cross section existing between it and the valve seat (79) is at least approximately constant over the radial course of the annular face (84).

15. The valve of claim 1, further comprising an annular groove (85) indented relative to the annular face (84) and disposed on the face end of the valve member (72), between the sealing face (81) and the annular face (84).

16. The valve of claim 2, further comprising an annular groove (85) indented relative to the annular face (84) and disposed on the face end of the valve member (72), between the sealing face (81) and the annular face (84).

17. The valve of claim 1, wherein the sealing face (81) is embodied on an at least approximately cylindrical inner extension (80) of the valve member (72); and wherein the annular face (84) is embodied on an at least approximately cylindrical outer extension (83) of the valve member (72) that has a larger diameter than the inner extension (80).

18. The valve of claim 1, wherein the valve member (72) in the valve pressure chamber (77) is at least approximately pressure-balanced, so that at least approximately no resultant pressure force acts on it in the direction of its longitudinal axis (73).

19. The valve of claim 1, wherein, when the valve member (72) with its sealing face (81) is resting on the valve seat (79), an at least approximately laminar flow of low flow velocity develops between the annular face (84) and the valve seat (79).

20. A fuel injection system for an internal combustion engine, the system comprising one high-pressure fuel pump (10) and one fuel injection valve (12), communicating with the pump, for each cylinder of the engine, the high-pressure fuel pump (10) having a pump piston (18), driven in a reciprocating motion by the engine and defining a pump work chamber (22) that communicates with a pressure chamber (40) of the fuel injection valve (12), the injection valve (12) having an injection valve member (28), by which at least one injection opening (32) is controlled and which is movable by the pressure prevailing in the pressure chamber (40), counter to a closing force (44), in an opening direction (29) to open the at least one injection opening (32), a first electrically actuated control valve (68), by which at least indirectly a communication (66) of the pump work chamber (22) with a relief chamber (24) is controlled, and a second electrically actuated control valve (70), by which at least one communication (64) of a control pressure chamber (52) with the relief chamber (24) is controlled, the injection valve member (28) being acted upon at least indirectly in a closing direction by the pressure prevailing in the control pressure chamber (52), the first control valve (68) and/or as the second control valve (70) being a valve as defined in claim 1.

* * * * *